United States Patent [19]

Bryan et al.

[11] 4,369,708

[45] Jan. 25, 1983

[54] DELAY BLASTING CAP

[75] Inventors: Paul J. Bryan, Hewitt; Daniel R. Morse, Bloomingdale, both of N.J.

[73] Assignee: E. I. Du Pont de Nemours and Company, Wilmington, Del.

[21] Appl. No.: 77,718

[22] Filed: Sep. 21, 1979

[51] Int. Cl.[3] ..... F42B 3/16

[52] U.S. Cl. ..... 102/202.13; 102/202.14

[58] Field of Search ..... 102/28, 29, 27, 202.5, 102/202.13, 202.14, 275.3, 275.9, 277.1, 277.2

[56] References Cited

U.S. PATENT DOCUMENTS

| | | | |
|---|---|---|---|
| 1,928,205 | 9/1933 | Large | 102/28 R |
| 2,767,655 | 10/1956 | Seavey | 102/28 |
| 2,771,033 | 11/1956 | Lewis et al. | 102/28 |
| 2,773,447 | 12/1956 | Hall et al. | 102/28 |
| 2,878,752 | 3/1959 | Johnson et al. | 102/28 |
| 2,991,714 | 7/1961 | Noddin | 102/28 |
| 2,999,460 | 9/1961 | Stinger et al. | 102/28 |
| 3,021,786 | 2/1962 | Miller et al. | 102/27 |
| 3,188,914 | 6/1965 | Dahl | 102/28 X |
| 3,556,009 | 1/1971 | Thatcher | 102/202.13 |
| 3,759,183 | 9/1973 | Apstein | 102/28 R |
| 3,817,181 | 6/1974 | Persson et al. | 102/29 |
| 4,239,004 | 12/1980 | Day et al. | 102/202.13 |

FOREIGN PATENT DOCUMENTS

| | | | |
|---|---|---|---|
| 2159612 | 6/1973 | France | 102/28 R |

*Primary Examiner*—Harold J. Tudor
*Attorney, Agent, or Firm*—D. C. Ascani

[57] ABSTRACT

A delay blasting cap having improved uniformity and predictability of delay time, and less susceptible to timing change as a result of a change in the medium or temperature surrounding the cap, has a polyolefin or polyfluorocarbon carrier capsule or tube for the delay charge, and preferably a rigid metal capsule holding the delay charge in place. Preferably, the delay carrier is a polyethylene capsule, which inhibits the priming charge from penetrating into the delay charge during the assembling of the cap.

11 Claims, 2 Drawing Figures

DELAY BLASTING CAP

BACKGROUND OF THE INVENTION

1. Field of the Invention

The present invention relates to delay blasting caps, and more particularly to electric and non-electric blasting caps having a carrier-supported delay charge of an exothermic-burning composition adjacent to a priming charge of a heat-sensitive detonating explosive.

2. Description of the Prior Art

The art of delay blasting is practiced widely in underground and open-work blasting operations as a means of improving rock fragmentation and displacement; providing greater control of vibration, noise, and fly rock; reduce the powder factor; and reduce blasting costs. Short-interval or millisecond-delay caps (e.g., caps having nominal delay times of no greater than about 1000 milliseconds) and long-interval delay caps (e.g., those having nominal delay times of greater than about 1000 milliseconds) have been designed around the needs of different blasting requirements. At the present time, millisecond (MS) delays are the most widely used delay caps for quarry, open-pit, and construction projects, and they are also used in underground mines for multiple-row slabbing blasts, stope blasts, and other production blasts where rows of holes are breaking to a free face. Typically, MS delay blasts will move rock farther away from the face than long-interval delay blasts because of the interaction between successive boreholes fired at the shorter delay intervals. The nominal time interval between periods of successive caps in an available series often is as low as 25 milliseconds for lower-delay-period MS caps, although it can be up to 100 milliseconds for higher-delay-period MS caps, and up to about 500–600 milliseconds for long-interval delay caps.

An important prerequisite to successful delay, especially MS delay, blasting is that the delay times of a number of caps of stated delay rating be as uniform as possible from cap to cap. Desirably, the variation from the nominal value of the delay times of a given group of caps of assigned nominal delay time should be small enough that no less than 8 ms elapse between the firing of caps of any two consecutive periods. This would mean a maximum variation of ±8 ms for caps in the 25-ms; ±21 ms for those in the 50-ms; and ±46 ms for those in the 100-ms interval series. Without good uniformity, it is difficult to achieve a desired fragmentation, vibration reduction, etc. as expected from a given delay pattern.

In delay blasting caps, the delay interval, i.e., the time between the application of electrical or percussive energy and the detonation of the cap, is provided by the interposition of a delay charge of an exothermic-burning composition between the ignition system and the priming charge of heat-sensitive detonating explosive. The burning rate of the delay composition and the length of its column determine the delay interval. While in some caps the delay charge is pressed, without any surrounding element, directly into the cap shell over the priming charge, usually the delay charge is housed within a heavy-walled rigid carrier tube, e.g., as shown in U.S. Pat. Nos. 2,999,460 (FIG. 1) and 3,021,786 (FIG. 2). Use of a carrier tube is desirable in that the smaller loading (i.e., weight of charge per unit length) associated therewith allows the charge to be lengthened (to provide longer delays) without concomitantly increasing the total weight of the charge to a level which may be sufficient to burst the cap shell and deleteriously affect the delay timing.

The delay carriers heretofore known in the art have been mostly heavy-walled metal, usually lead tubes, although the aforementioned U.S. Pat. No. 2,999,460 states that the heavy-walled carrier shown in FIG. 1 therein is, for example, lead or plastic tubing. Also, U.S. Pat. No. 2,771,033 describes a core of a delay composition surrounded by a flexible textile envelope; and U.S. Pat. No. 2,773,447 describes the delay core surrounded by a thin paper- or textile-covered sheath that melts as the delay composition burns.

SUMMARY OF THE INVENTION

The present invention provides an improvement in a delay blasting cap comprising a tubular metal shell integrally closed at one end and containing in sequence from the closed end:

(a) a base charge of a detonating explosive composition, e.g., pressed granular pentaerythritol tetranitrate (PETN);

(b) a priming charge of a heat-sensitive detonating explosive composition, e.g., lead azide;

(c) a delay charge of an exothermic-burning composition, e.g., a boron/red lead mixture;

and (d) an ignition assembly for igniting the delay charge;

said improvement comprising a layer of polyolefin or polyfluorocarbon, preferably at least about 0.5 millimeter thick, between the delay charge and the inner wall of the tubular metal shell, and the priming charge in a form adapted to substantially inhibit its penetration into the delay charge during the loading of the tubular metal shell.

In a preferred embodiment of the invention the priming charge is in a form adapted to inhibit its penetration into the delay charge by virtue of a barrier layer, e.g., a layer of polyolefin or polyfluorocarbon, between the delay charge and the priming charge to the extent that an interface between these charges exists only in a small area near the axis of the tubular metal shell. In this embodiment, the delay charge most preferably is held in a tubular polyolefin or polyfluorocarbon capsule nested within the tubular metal shell and having one open extremity and a closure at the other extremity provided with an axial orifice therethrough, the closure on the capsule being adjacent to the priming charge.

In a different embodiment, the delay charge is held in a polyolefin or polyfluorocarbon tube and the priming charge is in a sufficiently compact form that it is not disturbed by the pressing of said tube thereon to the degree that the priming charge is able to penetrate substantially into the delay charge.

A preferred delay blasting cap of the invention also has a tubular rigid metal capsule nested within the polyolefin or polyfluorocarbon delay-carrying tube or capsule, the rigid metal capsule having one open extremity and a closure at the other extremity provided with an axial orifice therethrough, the closure on the capsule being adjacent to the delay charge and the open extremity preferably facing the ignition assembly in the cap.

BRIEF DESCRIPTION OF THE DRAWING

In the accompanying drawing.

DETAILED DESCRIPTION

Figure 1:
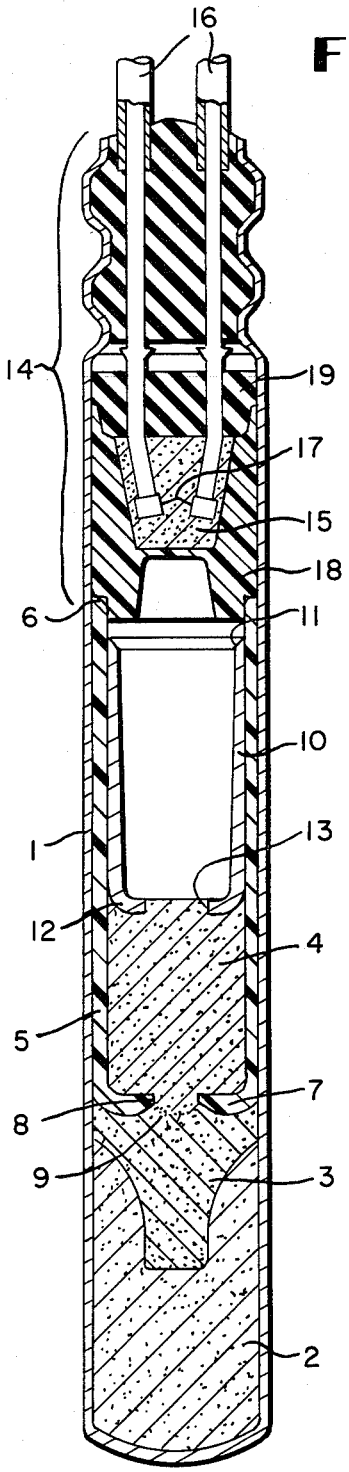
FIG. 1 is a longitudinal cross-section of an electrical delay blasting cap of the invention wherein the delay charge is held in a polyolefin or polyfluorocarbon capsule.

In FIG. 1, 1 is a tubular metal shell having one integrally closed end, 2 is a base charge of a granular detonating explosive composition, 3 is a priming charge of a granular heat-sensitive detonating explosive composition, 4 is a delay charge of a granular exothermic-burning composition, and 5 is a tubular polyolefin or polyfluorocarbon capsule nested within shell 1 in snug fit therein, capsule 5 having one open extremity 6, and a closed extremity 7 is provided with an axial orifice 8. Capsule 5 is a holder or carrier for delay charge 4, its side wall providing a layer of polyolefin or or polyfluorocarbon between delay charge 4 and the inner wall of shell 1; and its closed extremity 7, which rests adjacent to priming charge 3, acting as a barrier layer between charges 3 and 4. A small axial interface 9 between charges 3 and 4 is present by virtue of axial orifice 8.

Tubular metal capsule 10 is nested within capsule 5 is snug fit therein, capsule 10 also having one open extremity 11, and a closed extremity 12 provided with an axial orifice 13. Capsule 10 is seated within capsule 5 with closed extremity 12 resting adjacent to delay charge 4. Open extremity 11 faces ignition assembly 14, which consists of heat-sensitive ignition composition 15, a pair of leg wires 16, and high-resistance bridge wire 17. Ignition composition 15 is seated within plastic ignition cup 18. Grooved rubber plug 19 is securely crimped in the open end of shell 1 over ignition composition 15, forming a water-resistant closure and firmly positioning the ends of leg wires 16 inside shell 1.

EXAMPLE 1

The blasting cap shown in the drawing was made as follows: Shell 1 was a standard blasting cap shell, e.g., a shell made of Type 5052 aluminum alloy, 5.486 cm long and having a 0.73-cm outer diameter and a 0.66-cm inner diameter. Base charge 2 consisted of 0.49 gram of PETN, which had been placed in shell 1 and pressed therein at 1220–1335 Newtons with a pointed press pin. Priming charge 3 was 0.17 gram of an 85/15 mixture (by weight) of dextrinated lead azide and the coarse lead salt of dinitrocresylate, this mixture having been loaded into shell 1 and pressed therein at 1335 Newtons with a flat pin. Capsule 5 was made of high-density polyethylene, was 2.16 cm long, and had an outer diameter of 6.5 mm and an inner diameter of 5.3 mm. Axial orifice 8 was 1.3 mm in diameter. Capsule 5 was pressed into shell 1 at 890 Newtons with an axially tipped pin shaped to prevent the entrance of charge 3 into capsule 5 through orifice 8. Delay charge 4, which was loosely loaded into capsule 5, was a mixture of boron and red lead, grained with polysulfide rubber, the weight of charge 4 (and therefore its length), and the boron content of the mixture varying depending on the delay period to be provided.

Capsule 10 made of commercial bronze, was 11.9 mm long, and had an outer diameter of 0.561 cm and a wall thickness of 0.5 mm. Axial orifice 13 was 2.8 mm in diameter. Capsule 10 was seated in capsule 5 at 1290 Newtons.

Components of ignition assembly 14 were plastic, e.g., polyethylene, ignition cup 18, heat-sensitive ignition charge 15, in this case 0.27 gram of a 2/98 boron/red lead mixture, grained with polysulfide rubber, and plastic-insulated metal (copper or iron) leg wires 16 having bared ends connected to 0.0396-mm-diameter, 1.00-ohm resistance bridge wire 17 embedded in the ignition charge. Ignition cup 18 was seated onto capsule 5.

The above blasting caps were made in 9 different delay periods, each having a delay charge selected to provide a different nominal delay time in 25- or 50-millisecond increments starting from the shortest period. Of the low of caps made in each period, 25 were tested for actual delay time when fired in air at 27° C. The results were as follows:

| Period Designation | Delay Charge Boron, % | Delay Charge Wt., g | Nominal Delay Time, ms | Measured Delay Time, ms. Min. | Max. | Mean | $\sigma^{(a)}$ | C.V.,[b] % |
|---|---|---|---|---|---|---|---|---|
| 1 | 2.0 | 0.55 | 75 | 73 | 82 | 77 | 3.6 | 3.4 |
| 2 | 2.0 | 0.84 | 100 | 94 | 105 | 102 | 2.6 | 2.5 |
| 3 | 1.5 | 0.58 | 125 | 117 | 132 | 125 | 3.6 | 2.9 |
| 4 | 1.5 | 0.77 | 150 | 143 | 156 | 151 | 3.3 | 2.2 |
| 5 | 1.5 | 0.97 | 175 | 172 | 185 | 179 | 2.9 | 1.6 |
| 6 | 1.3 | 0.78 | 200 | 183 | 209 | 198 | 6.2 | 3.1 |
| 7 | 1.3 | 1.06 | 250 | 232 | 256 | 246 | 5.5 | 2.3 |
| 8 | 1.0 | 0.82 | 300 | 290 | 308 | 301 | 6.5 | 2.1 |
| 9 | 1.0 | 0.97 | 350 | 343 | 373 | 354 | 7.6 | 2.1 |

[a]Standard Deviation
[b]Coefficient of Variance

CONTROL EXPERIMENT

In the case of blasting caps (nominal delay time: 200 ms) made substantially as described above except that capsule 5 was formed of nylon or a polyformaldehyde acetal resin, the cap shells (1) ruptured when the caps were fired, owing, it is believed, to the gas produced by the decomposition of these plastics.

EXAMPLE 2

The delay blasting caps of designated Periods 3, 7 and 9 described in Example 1 were tested for delay time when fired in air at 21° C. and in water at 27° C. Ten caps of each period were tested at each of these two conditions. The results are shown in the following table, together with those obtained when delay caps of the prior art of designated Periods 3 and 9 were tested under the same conditions (also ten of each period at each condition). In the prior art caps polyethylene capsule 5 was omitted.

| Blasting Cap | Air Measured Delay Time, ms. Min. | Air Max. | Air Mean | Air $\sigma$ | Air C.V., % | Water Measured Delay Time, ms. Min. | Water Max. | Water Mean | Water $\sigma$ | Water C.V., % | Timing Difference Air/Water ms. | Timing Difference Air/Water % |
|---|---|---|---|---|---|---|---|---|---|---|---|---|
| Ex. 1 | 118 | 138 | 127 | 5.7 | 4.5 | 122 | 134 | 127 | 3.7 | 2.9 | 0 | 0 |
| Ex. 1 | 229 | 258 | 249 | 8.8 | 3.5 | 248 | 257 | 252 | 3.1 | 1.2 | 3 | 1.2 |
| Ex. 1 | 336 | 366 | 352 | 9.5 | 2.7 | 347 | 369 | 356 | 8.5 | 2.4 | 4 | 1.1 |

-continued

| Blasting Cap | Air Measured Delay Time, ms. Min. | Max. | Mean | σ | C.V., % | Water Measured Delay Time, ms. Min. | Max. | Mean | σ | C.V., % | Timing Difference Air/Water ms. | % |
|---|---|---|---|---|---|---|---|---|---|---|---|---|
| Prior Art | 118 | 152 | 128 | 10.3 | 8.1 | 122 | 145 | 133 | 6.9 | 5.2 | 5 | 4 |
| Prior Art | 335 | 371 | 353 | 13.8 | 3.9 | 319 | 353 | 337 | 10.2 | 3.0 | 16 | 5 |

EXAMPLE 3

Figure 2:
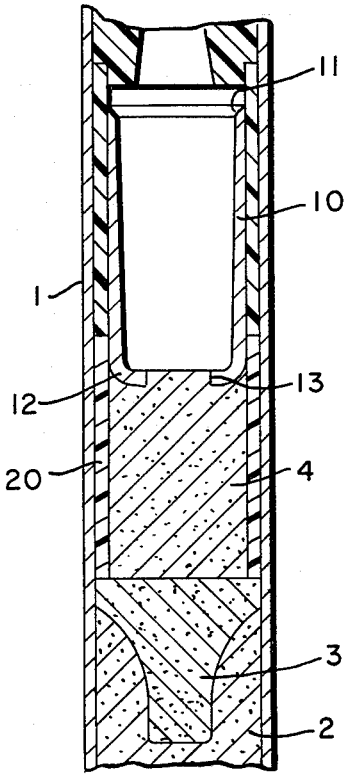
FIG. 2 is a partial longitudinal cross-section of a delay blasting cap of the invention wherein the delay charge is held in a polyolefin or polyfluorocarbon tube.

The cap depicted in FIG. 1 and described in Example 1 was made with the modification shown in FIG. 2. In this modification, capsule 5 was replaced by polyolefin or polyfluorocarbon tube 20, in this case two abutting polyethylene tube sections having a total length of 1.8 cm, an outer diameter of 0.64 cm, and an inner diameter of 0.54 cm. The press forces used in loading charge 3, tube 20, and capsule 10 into shell 1 were the same as those used in Example 1 to load charge 3, capsule 5, and capsule 10, respectively. The mean delay time of 15 of the described caps of designated Period 6 fired at 10° C. was 202 ms ($\sigma=8$); that of 15 caps of the same designated period fired at 27° C. was 198 ms ($\sigma=5.7$).

Prior art caps (same number of samples) of the same designated period but having no carrier for delay charge 4 had a mean delay time of 187 ms ($\sigma=9$) when fired at 10° C., and 174 ms ($\sigma=9$) when fired at 27° C. (i.e., a timing difference of 13 ms at the two different temperatures, in contrast to a difference of only 4 ms for the delay caps of the invention).

Prior art caps (same number of samples) of the same designated period but having a metal carrier tube for delay charge 4, and having also an electric match ignition assembly instead of assembly 14 shown in FIG. 1, had a mean delay time of 213 ms ($\sigma=11$) when fired at 10° C., and 206 ms ($\sigma=9$ when fired at 27° C. (timing difference of 7 ms).

The foregoing examples show that the delay blasting caps of the invention exhibit good uniformity and predictability of delay time when fired under a given set of conditions, and that the caps' delay times are not as greatly affected by the surrounding environment (temperature or density of the medium) as are those of prior art caps. The polyolefin or polyfluorocarbon carrier for the delay charge is advantageous in that it provides a better fit between the delay carrier and metal shell (and therefore a better seal for the priming charge) and eliminates the friction-related hazards associated with the fitting of a metal delay carrier into a metal cap shell over a priming explosive charge. In addition, one of the beneficial effects of the polyolefin or polyfluorocarbon carrier on delay timing is a reduction in the variability of the timing with changes in the surrounding temperature or medium (e.g., air vs. water).

The delay charge is an exothermic-burning composition, and can reach an extremely high temperature, e.g., about 1000° C. For this reason this charge heretofore has been confined in a heavy-walled carrier made of metal, or has been loaded directly into the metal cap shell. Although lead or plastic tubing is suggested in the aforementioned U.S. Pat. No. 2,999,460 for use as a heavy-walled delay carrier, many well-known plastics such as nylon and acetal resins undergo decomposition when in contact with the burning delay charge in a manner such that the integrity of the cap is destroyed, thereby nullifying the delay feature thereof. Thus it is understandable that blasting caps that heretofore have been provided with outer shells or cases made of plastic, e.g., the blasting caps described in U.S. Pat. No. 2,767,655, are instantaneous caps, i.e., caps which provide no delay.

An important feature of the delay blasting cap of this invention is that the priming charge is in a form adapted to substantially inhibit its penetration into the delay charge, preferably by virtue of a polyolefin or polyfluorocarbon capsule as the delay carrier, as shown in FIG. 1. When this carrier capsule is seated against the granular priming charge, the closed end of the capsule forms a barrier to prevent the entrance of grains of priming charge into the delay charge. It is believed that this isolation of the delay charge from the priming charge may contribute to the uniformity of delay timing of the cap. Complete isolation is not possible, of course, inasmuch as the continuity of the train of charges is required to ensure the detonation of the priming and base charges.

As is shown in Example 3, good timing uniformity also can be obtained if no barrier layer is present between the delay and priming charges provided that the press force used on the priming charge compacts it sufficiently to prevent the displacement of loosened surface grains when the carrier tube and delay charge are pressed into the cap shell over the priming charge. Especially when the delay carrier is an open-ended tube, the press force on the priming charge should be at least about 225 Newtons.

The delay carrier, i.e., capsule 5 in FIG. 1 or tube 20 in FIG. 2, is made of a molded or extruded polyolefin, e.g., polyethylene or polypropylene, or polyfluorocarbon, e.g., poly(tetrafluoroethylene), these plastic materials being uniquely suited for use in direct contact with the exothermic-burning delay charge in a blasting cap. More particularly, these plastics, when subjected to the heat produced by the burning of the delay charge in contact therewith, melt readily without undergoing gas-evolving decomposition capable of rupturing the outer shell of the blasting cap. In more specific terms in the case of a 350 ms delay, for example, any given point on the plastic must be capable of withstanding exposure to a 1-mm flame front (e.g., at a temperature of about 1000° C.) for about 35 ms.

Inasmuch as the time interval between the application of the ignition impulse and the detonation of the cap is determined by the burning rate of the delay charge and the length of its column, for a given delay composition longer carriers may be needed to accommodate the longer delay charges required in longer-period caps. Shell 1 also may need to be longer for this reason. The diameter of the delay charge can be varied by varying the wall thickness of the carrier capsule or tube. Therefore, if a longer delay is to be achieved with a given delay composition by lengthening the column thereof, the diameter of the charge can be reduced for all or part of its length to avoid a total delay load that may be too large for the cap shell to withstand. Without the carrier capsule or tube which is present in the delay cap of the invention, if lengthening the delay column would cause too large a total load of delay charge, it would be necessary to employ a slower-burning composition to achieve a longer delay, and less uniformity of timing could result. Generally, the carrier wall will be at least about 0.5 mm, and no more than about 1.7 mm, thick, and the diameter of the delay charge will be at least about 3 mm.

In a preferred cap of the invention, a tubular rigid metal capsule (10 in the drawing) which has one closed end provided with an axial orifice, is nested within the delay-carrying capsule or tube with its closed end seated against the delay charge, preferably so that its open end faces the ignition end, rather than the exploding end, of the cap. This metal capsule, which may be made, for example, of bronze, copper, or steel, or of aluminum if sufficiently thick, expands the delay carrier to seal it against the cap shell, helps retain the delay charge in place, and reinforces the cap shell against collapse by shock.

The particular compositions selected for the various charges in the detonator are not critical to the present invention, provided that the selected compositions function in the specified manner. The delay charge can be any of the gasless exothermic-reacting mixtures of solid oxidizing and reducing agents that burn at a constant rate and that are commonly used in ventless delay detonators. Examples of such mixtures are boron-red lead, boron-red lead-dibasic lead phosphite, aluminum-cupric oxide, magnesium-barium peroxide-selenium, and silicon-red lead. The charge should be pressed into the carrier with a force of at least about 890 Newtons.

The priming charge can be any heat-sensitive detonating explosive composition which is readily initiated by the burning of the delay composition, e.g., lead azide, mercury fulminate, diazodinitrophenol, or a similar composition.

The composition used for the base charge can be any of the conventional base charges, e.g., PETN, cyclotrimethylenetrinitramine, cyclotetramethylenetetranitramine, lead azide, picryl sulfone, nitromannite, TNT, and the like. This charge can be loose or compacted.

The blasting cap of the invention can be electrical or non-electrical. A preferred ignition assembly for an electrical cap is shown in FIG. 1. However, other well-known electrical ignition assemblies, such as those shown in U.S. Pat. Nos. 2,771,033 and 2,773,447, can be employed to ignite the delay charge. In a non-electric cap the electrical ignition assembly can be replaced by an ignition assembly wherein an ignition charge is ignited by a pressure pulse applied thereto by the detonation of a detonating cord, as is shown in FIG. 2 of U.S. Pat. No. 3,021,786 and in FIG. 2 of co-pending U.S. application Ser. No. 177,210, filed Aug. 11, 1980, now U.S. Pat. No. 4,335,652, which is a continuation-in-part of Ser. No. 15,288, filed Feb. 26, 1979, now abandoned. The disclosures of this patent and this co-pending application are incorporated herein by reference.

We claim:

1. In a delay blasting cap comprising a tubular metal shell integrally closed at one end and containing, in sequence from the closed end, (a) a base charge of a detonating explosive composition, (b) a priming charge of a heat-sensitive detonating explosive composition, (c) a delay charge of an exothermic-burning composition, and (d) an ignition assembly for igniting said delay charge, the improvement comprising a carrier element for said delay charge, said carrier element consisting of a capsule or tube whose side wall provides a layer of polyethylene, polypropylene, or polytetrafluoroethylene between said delay charge and the inner wall of said tubular metal shell, said layer having a thickness in the range of about from 0.5 mm to 1.7 mm, said delay charge having been pressed into said carrier element with a force of at least about 890 Newtons, and said priming charge being inhibited from penetrating into said delay charge by at least one of the following means: (1) pressing said priming charge into said shell with a force of at least about 225 Newtons, and (2) a barrier layer between said delay charge and said priming charge.

2. A delay blasting cap of claim 1 wherein a barrier layer is present between said delay charge and said priming charge to the extent that an interface between said charges exists only in a small area near the axis of said tubular metal shell.

3. A delay blasting cap of claim 2 wherein said barrier layer is made of a polyolefin or a polyfluorocarbon.

4. A delay blasting cap of claim 3 wherein said carrier element is a tubular capsule nested within said tubular metal shell and having one open extremity and a closure at the other extremity provided with an axial orifice therethrough, said capsule's side wall forming said layer between said delay charge and the inner wall of said tubular metal shell, and said capsule's closure forming said barrier layer.

5. A delay blasting cap of claim 1 wherein said delay charge is held in a tube nested within said tubular metal shell, said tube's side wall forming said layer between said delay charge and the inner wall of said tubular metal shell, and said priming charge being inhibited from penetrating into said delay charge by virtue of having been pressed into said shell with a force of at least about 225 Newtons.

6. A delay blasting cap of claim 1 or 2 wherein said delay charge is a pressed granular mixture of boron and red lead containing about from 0.5 to 2.5 percent boron.

7. A delay blasting cap of claim 1 or 2 wherein said ignition assembly contains an ignition charge ignitible by the delivery of electrical energy thereto.

8. A delay blasting cap of claim 1 or 2 wherein said ignition assembly contains an ignition charge ignitible by a pressure pulse applied thereto by the detonation of a detonating cord.

9. In a delay blasting cap comprising a tubular metal shell integrally closed at one end and containing, in sequence from the closed end, (a) a base charge of a detonating explosive composition, (b) a priming charge of a heat-sensitive detonating explosive composition, (c) a delay charge of an exothermic-burning composition, and (d) an ignition assembly for igniting said delay charge, the improvement comprising (1) a tubular polyolefin or polyfluorocarbon capsule holding said delay charge and nested within said tubular metal shell, said tubular polyolefin or polyfluorocarbon capsule having one open extremity and a closure at the other extremity provided with an axial orifice therethrough, said closure on said polyolefin or polyfluorocarbon capsule being adjacent to said priming charge; and (2) a tubular rigid metal capsule nested within said polyolefin or polyfluorocarbon delay-charge-carrying capsule, said rigid metal capsule having one open extremity and a closure at the other extremity provided with an axial orifice therethrough, said closure on said rigid metal capsule being adjacent to said delay charge.

10. In a delay blasting cap comprising a tubular metal shell integrally closed at one end and containing, in sequence from the closed end, (a) a base charge of a detonating explosive composition, (b) a priming charge of a heat-sensitive detonating explosive composition, (c) a delay charge of an exothermic-burning composition, and (d) an ignition assembly for igniting said delay charge, the improvement comprising (1) a polyolefin or polyfluorocarbon tube holding said delay charge and nested within said tubular metal shell, and (2) a tubular rigid metal capsule nested within said polyolefin or polyfluorocarbon delay-charge-carrying tube, said rigid metal capsule having one open extremity and a closure at the other extremity provided with an axial orifice therethrough, said closure on said rigid metal capsule being adjacent to said delay charge, and said priming charge being inhibited from penetrating into said delay charge by virtue of having been pressed into said shell with a force of at least about 225 Newtons.

11. A delay blasting cap of claim 9 or 10 wherein said open extremity of said rigid metal capsule faces said ignition assembly.

* * * * *